US005674132A

United States Patent [19]

Fisher

[11] Patent Number: 5,674,132

[45] Date of Patent: Oct. 7, 1997

[54] GOLF CLUB HEAD WITH REBOUND CONTROL INSERT

[76] Inventor: Dale P. Fisher, 18055 Bushard, Fountain Valley, Calif. 92708

[21] Appl. No.: 543,813

[22] Filed: Oct. 16, 1995

Related U.S. Application Data

[63] Continuation-in-part of Ser. No. 416,135, Apr. 4, 1995, Pat. No. 5,458,332, which is a continuation-in-part of Ser. No. 236,583, May 2, 1994, abandoned.

[51] Int. Cl.[6] ..... A63B 53/04

[52] U.S. Cl. ..... 473/290; 473/329; 473/342; 273/DIG. 8

[58] Field of Search ..... 473/324, 329, 473/332, 340, 288, 290, 251, 342, 347, 349; 273/DIG. 8, DIG. 3, DIG. 10

[56] References Cited

U.S. PATENT DOCUMENTS

| | | |
|---|---|---|
| 3,679,207 | 7/1972 | Florian . |
| 4,156,526 | 5/1979 | Huggins . |
| 4,422,638 | 12/1983 | Tucker . |
| 4,679,792 | 7/1987 | Straza . |
| 4,681,322 | 7/1987 | Straza . |
| 4,722,528 | 2/1988 | Tsao . |
| 4,869,507 | 9/1989 | Sahm . |
| 5,083,778 | 1/1992 | Douglas . |
| 5,405,136 | 4/1995 | Hardman . |
| 5,458,332 | 10/1995 | Fisher . |

FOREIGN PATENT DOCUMENTS

| | | | |
|---|---|---|---|
| 2124910 | 2/1984 | United Kingdom | 273/167 J |
| 2584299 | 1/1987 | United Kingdom | 273/173 |
| 2259863 | 3/1993 | United Kingdom | 273/173 |

OTHER PUBLICATIONS

STX, The Better Putter, 1500 Bush St., Baltimore, MD 21230. pp. 2 and 3 of 4–page brochure 1990.

*Primary Examiner*—Sebastiano Passaniti
*Attorney, Agent, or Firm*—William L. Chapin

[57] ABSTRACT

A golf club providing improved control of distance and direction of a golf ball impacted by the club includes a resilient insert having a controlled rebound factor fitted into a recess provided in the face of the club head. In the preferred embodiment, the insert comprises one or more thin laminations, each having an intrinsic rebound factor and thickness selected to yield in combination an overall composite ball-impacting rebound factor that may be varied over a relatively wide range of rebound factors, preferably which are an approximately linear function of desired travel range of the impacted ball. Also in the preferred embodiment, the inserts are made of a material in which the hardness may be varied somewhat independently from rebound factor, thus allowing construction of a club having a desired ball-impacting feel as well as selected rebound factor.

29 Claims, 6 Drawing Sheets

GOLF CLUB HEAD WITH REBOUND CONTROL INSERT

This application is a continuation-in-part of application Ser. No. 08/416,135, filed Apr. 04, 1995, now U.S. Pat. No. 5,458,332 which is a continuation-in-part of application Ser. No. 08/236,583, filed May 02, 1994, now abandoned.

BACKGROUND OF THE INVENTION

A. Field of the Invention

The present invention relates to articles used in the game of golf. More particularly, the invention relates to improvements in the construction of golf club heads that provide greater control of the direction and speed of balls hit by the clubs.

B. Description of Background Art

In theory, golf is a simple game, merely requiring that the player advance a ball from a tee located at the beginning of a fairway into a cup or "hole" located on a green at the end of a fairway, by successively hitting the ball with selected clubs a minimum number of times, or strokes. This progression from tee to green is repeated for the nine or eighteen seriatim fairways or holes which the particular golf course is segmented into. In practice, however, the game of golf can be very frustrating, for a number of reasons.

For long "holes," beginning golfers frequently experience problems with their "long game," i.e., have difficulty in hitting the ball squarely with sufficient force to traverse the fairway from tee to green with a minimum number of strokes. However, for most people that are not physically handicapped, a facility for hitting "long" balls can be developed in a relatively short time, by practicing at driving ranges, for example. On the other hand, beginning golfers often find that, although the skills required to advance the ball from the tee to the vicinity of the green in a reasonable number of strokes can be achieved in a relatively short time, "holing" the ball in the cup can add sufficient strokes to far exceed "par," the idealized, average number of strokes determined to be achievable by expert golfers playing the same hole.

Oftentimes, beginning golfers add excessive strokes to their game because of difficulties experienced in putting the ball into the cup from distant locations on the green. Putting difficulties can arise from the fact that a different set of motor skills are required for putting than for driving the ball from the tee, or hitting long fairway shots. The latter require expenditure of substantial amounts of kinetic energy by the golfer in imparting enough momentum to the ball to propel it for long distances. In putting, raw power or brute force is ineffectual, and the beginning golfer must acquire a substantial amount of finesse in hitting a ball residing on the green, to avoid overshooting the cup and adding unwanted strokes to his game.

Since the amount of momentum that must be imparted to a putted ball is so much less than required to drive a ball appreciable distances, beginning golfers often "pull" their club on short putts, i.e., fail to follow through on their stroke. This pulling or "choking" is detrimental, since the directional control of the impacted ball is adversely affected by such actions. Accordingly, many beginner golfers are confronted with the frustrating situation of putting the ball with good accuracy but over the cup, when utilizing their newly acquired skills for long-ball hitting with appropriate follow-through in their stroke. Conversely, choked or pulled strokes can result in the putted ball stopping short of the cup, or deviating substantially away from the cup.

The putting difficulties alluded to above are exacerbated by the substantial variations normally encountered in the conditions of greens. Thus, greens on which the grass is closely trimmed and dry offer minimum rolling resistance to a golf ball, and are "fast." Conversely, greens on which the grass is long and/or wet present substantial rolling resistance to a rolling golf ball, and are "slow." Therefore, the exact amount of momentum that must be delivered to hole a ball varies substantially as a function of green conditions, as well as with distance from the cup.

In recognition of the problems encountered with putting by beginners as well as even relatively experienced golfers, the present inventor disclosed a novel putter design to improve putting skills, in U.S. patent application Ser. No. 08/416,135 filed Apr. 05, 1995, now U.S. Pat. No. 5,548,332, issued Oct. 17, 1995, for a Golf Putter Head With A Cushioning Face. That application discloses a series of golf putter heads, each having on the front face thereof a polymer pad having a different coefficient of restitution, or rebound factor. For short putts and/or fast greens, a small rebound factor of, say 12.5% was disclosed as being desirable for putts of about 10 feet, 25% for 15–20 foot putts, 37.5% for putts of about 30 feet, and 50% for putts of 40 feet or greater.

By selecting a particular putter from a series of putters fitted with inserts having different rebound factors, the disclosed invention enabled golfers to utilize strokes that varied over a smaller power range, even for widely varying putting distances and green conditions. For example, by using a putter having an insert with a low rebound factor of 12.5%, the ball may be struck with nearly the same vigor for a 10 foot putt as for a 40 foot putt using a putter having a higher rebound factor of 50%. Therefore, the player can use a complete stroke with the follow through required for accurately launching the ball towards the cup, even for short putts and/or fast greens, by using a putter having an insert with an appropriately low rebound factor.

In addition to the substantial contribution to improved putting afforded by putters having inserts with rebound factors optimized to various putting situations, the present inventor's prior application disclosed putters in which the rebound factor of an insert could be varied somewhat independently of hardness. This capability permits the feel of the club upon impacting the ball to be adjusted somewhat, thus allowing inserts with varying rebound factors to provide similar sensory feedback upon impacting a golf ball.

The golf putter heads described in the present inventor's prior application referred to above provided a substantial contribution to improving a golfer's putting performance. However, a problem still existed for golfers approaching the green.

In the "short" portion of a golf game, it is usually necessary to hit the ball onto the green from a fairway, rough or sand trap. Such locations are oftentimes well within a golfer's maximum distance hitting capability. Accordingly, clubs with an inclined front face that provide a substantial vertical component (loft) to the ball trajectory are often used in approaching the green. A high trajectory minimizes the likelihood of overshooting the green, and results in the ball impacting the green at a relatively steep angle, thereby minimizing roll away from the impact point. In spite of making a careful choice of the best club to prevent exceeding a desired horizontal range, many players are confronted in their short games with the same dilemma as in putting; namely, maintaining normal swing and follow through to achieve good trajectory direction, and possibly overshooting an intended impact point, or pulling the shot to decrease horizontal range, while adversely affecting angular or bearing accuracy, and/or falling short of a desired impact point.

In view of the problems alluded to above, it occurred to the present inventor that some of the novel improvements which he disclosed for putters might be adapted to other varieties of golf clubs, including wedges and other irons, as well as woods. Such considerations were in part a motivation for the present invention.

In the course of applying the present inventor's prior disclosed improvements in putter construction to other types of golf clubs, it was found that the larger ball impact forces typically encountered in using the latter suggested a somewhat more rugged design, to ensure that the polymeric insert on the club face could be attached securely to a club head, and by a relatively simple manufacturing technique. As it turns out, the newly conceived design for improved woods and irons turned out to be advantageously useable with the putter head design previously disclosed by the present inventor.

OBJECTS OF THE INVENTION

An object of the present invention is to provide an improved golf club head having a controlled rebound factor.

Another object of the invention is to provide a golf club head having at the intended ball impact region of the club head face a resilient material having a known rebound factor, tailored to a particular set of playing conditions.

Another object of the invention is to provide a golf club head having in the face thereof a resilient insert made from a material having a controlled rebound factor selected to be suitable for particular playing conditions.

Another object of the invention is to provide a golf club head having in the face thereof a resilient insert of controlled rebound factor and surface hardness.

Another object of the invention is to provide a golf club head having in the face thereof an insert comprising a plurality of laminations which may have different thicknesses, intrinsic rebound factors and hardnesses, whereby the composite rebound factor and hardness of the multi-layer lamination may be varied over a relatively larger range than obtainable with a single lamination.

Another object of the invention is to provide a series of golf club heads, each having a face insert with a different rebound factor, suited to different playing conditions.

Another object of the invention is to provide a golf club head having a face-mounted rebound control insert that is mechanically interlocked with the body of the head.

Another object of the invention is to provide a golf club head having a face mounted rebound control insert made of a resilient material, whereby the insert remains in fixed relationship with respect to the club head in spite of differential thermal expansions of the insert and head.

Another object of the invention is to provide a golf club head having a wedge-shaped rebound control insert that is secured in a complementarily-shaped recess in the face of the club head, at least in part by a wedging interference fit.

Another object of the invention is to provide a golf club head having a rebound control insert that is readily viewable with the club head in position to impact a ball.

Another object of the invention is to provide a series of golf clubs, each provided with a face insert having a different, color-coded, rebound control factor.

Another object of the invention is to provide a protective mitt or cover for golf clubs, the mitt having a transparent window positioned over a color-coded insert on a club head covered by the mitt.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends improved golf clubs, in which the ball-impacting face of the club head is provided with a resilient insert made of a material having a controlled rebound factor. Preferably the resilient material comprises an insert fitted into a recess in the face of the club head. According to one aspect of the invention, the rebound factor of the insert is selected from a first plurality of values, to suit a particular given playing situation, higher rebound factors generally being selected when it is desired to hit a golf ball greater distances.

According to another aspect of the invention, a rebound control insert construction is provided which also allows the hardness of the insert to be selected from a second plurality of values. Thus, the insert construction according to the present invention allows a golfer to select a desired hardness value as well as rebound factor, to provide a desired feel upon impacting a ball.

In one embodiment of the invention, the thickness of an insert made from a given material may be varied to value selected from a third plurality of values, therefore allowing the resultant overall ball rebound factor and perceptible hardness to be varied over larger ranges than obtainable by varying insert material composition alone.

In a modification of a basic rebound control insert construction according to the present invention, the insert is fabricated as a multi-layer structure comprising two or more insert laminations. The composition, rebound control factor, hardness and thickness of each of the insert laminations may be varied, resulting in a substantially larger range of possible values of overall rebound factor and surface hardness. In the preferred embodiment of the invention, a rebound control insert made of a resilient polymer is located in a recess provided in the front face of a golf club head and has a relatively flat front face which is parallel to, and approximately flush with, portions of the club head face adjacent to the recess. Also in the preferred embodiment of the invention, the recess and insert cooperatively interact to provide a wedging or locking action that assists in positively securing the insert to the club head.

In a representative embodiment of the present invention, the recess and insert both have trapezoidal or wedge-shaped plan views, with side walls that taper inwardly from the bottom to top of the club face. With this arrangement, an insert slid into the bottom opening of the recess, which penetrates the lower surface or sole of the club head, will be limited in upward vertical travel in the recess, the outer side walls of the insert wedging against the inner side walls of the recess to form an interference fit that aids in locking the insert securely into place within the recess. Preferably, the insert is made of a resilient polymer. Thus, differential thermal expansion of the club head and insert will not warp the insert, a problem which could occur with golf club heads having hard inserts and left in hot automobiles.

In the preferred embodiment, the recess and insert also both penetrate the upper surface of the club head. With this construction, the upper surface of the insert provides a visual indicator that helps a golfer to impact a ball with the center of percussion, or "sweet spot" of the club head aligned with the impact velocity vector. Viewability of the insert may be enhanced by making it a different color than the main body of the club head. According to one aspect of the invention, a series of club heads may be provided in which different colored inserts denote different rebound factors. According to another aspect of the invention, a novel protective mitt is provided which may be used to cover the head of a club fitted with a color-coded insert, when the club is not in use. The protective mitt has a transparent insert or window that overlies the club head insert. With this arrangement, a golfer may readily select from a plurality of covered golf clubs a club having a desired color-coded rebound control insert, by viewing the insert through the mitt window.

In variations of the basic embodiment of rebound control inserts according to the present invention, the outer, ball-contacting face of an insert may be textured, scored or grooved to provide better transverse traction against the surface of an impacted ball, thereby providing substantially improved spin control of the ball.

DESCRIPTION OF THE PREFERRED EMBODIMENTS

Referring now to FIGS. 1–13, golf clubs with wedging rebound control inserts according to the present invention are shown.

Figure 1:
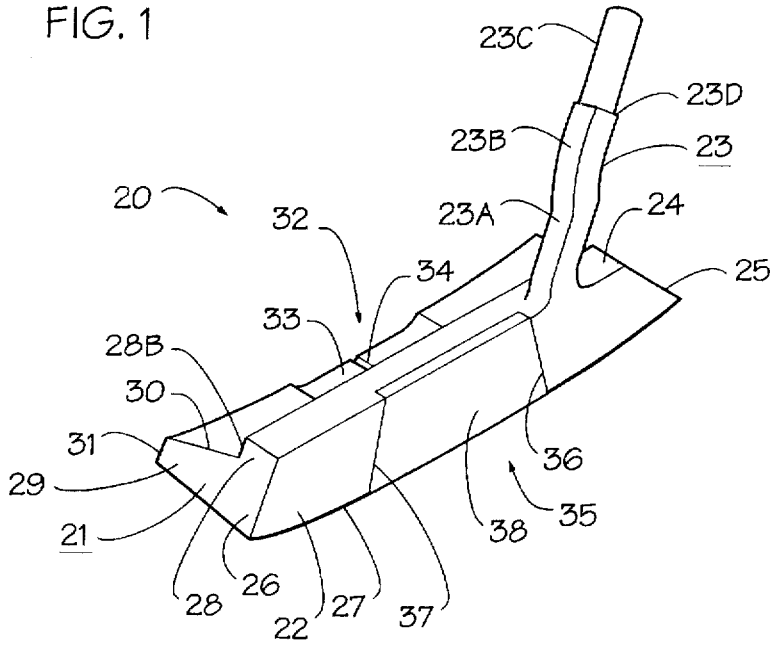
FIG. 1 is an upper perspective view of a golf club putter head with a wedging rebound control insert according to the present invention.

FIGS. 1–5 illustrate a golf club putter head with a wedging rebound control insert according to the present invention. As shown in FIG. 1, a golf club putter head 20 according to the present invention includes a horizontally elongated body 21 having a generally flat, vertically disposed front face 22 adapted to impacting a golf ball. Club head body 21 has an elongated, generally cylindrical shank 23 that protrudes upwards from the upper wall 24 of the body. As shown in FIG. 1, shank 23 joins upper wall 24 of body 21 at a location offset laterally a substantial distance from the center of the front face, near the right lateral side wall 25 of the body. As is also shown in FIG. 1, in front elevation view, shank 23 has a lower portion 23A that protrudes substantially vertically upwards from upper wall 24 of body 21, and intermediate and upper portions 23B and 23C, respectively, that angle laterally away from a vertical center line through the body.

Figure 3:
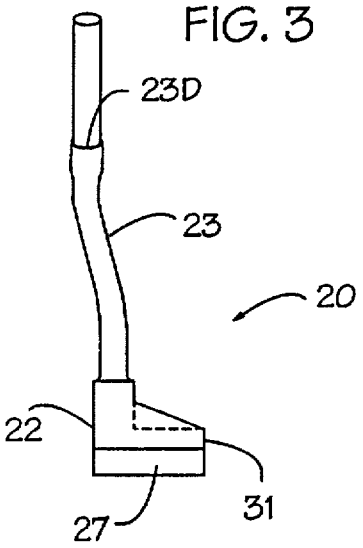
FIG. 3 is a right side elevation view of the club head of FIG. 1.

As may be seen best by referring to FIG. 3, in side elevation view, lower portion 23A of shank 23 angles sinuously forward from the front face 22 of body 21, while intermediate portion 23B bends rearward to join upper portion 23C, the latter two portions lying in a laterally disposed vertical plane.

As shown in FIGS. 1 and 3, upper portion 23C of shank 23 has a circular cross section which is adapted to be insertably received within the bore of tubular golf club shaft (not shown). Preferably, upper cylindrical portion 23C of shank 23 is of smaller diameter than the adjacent part of intermediate portion 23B of the shank, and is joined thereto by an annular shoulder 23D. Shoulder 23D provides a seating surface for the lower annular wall surface (not shown) of a golf club shaft (not shown) that receives shank 23.

Figure 4:
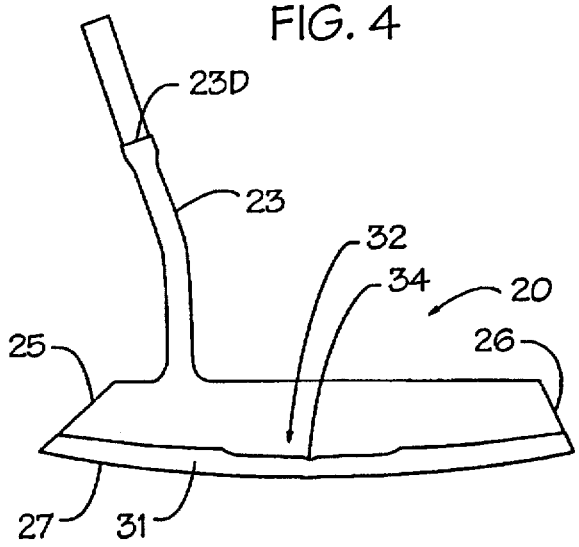
FIG. 4 is a rear elevation view of the club head of FIG. 1.

As may be seen best by referring to FIG. 1, body 21 of putter head 20 has a flat, convexly curved lower wall surface 27. As shown in FIGS. 1, 3 and 4, putter head body 21 has an upper laterally disposed rectangular cross section rib portion 28 protruding downwards from upper wall surface 24 of the body. Also, the rear portion of body 21 includes a trapezoidal cross section portion 29 having an upper wall 30 that intersects rear wall 28B of rib portion 28 below upper surface 24, the upper wall sloping downwards and rearwards to intersect rear vertical wall surface 31 of the body. As may be seen best by referring to FIGS. 1 and 4, a lateral, medial portion of trapezoidal portion 29 of putter head body 21 is cut downwards from sloping upper wall 30 to form a notch 32. The lower wall surface 33 of notch 32, which forms with lower wall surface 27 of body 21 a thin web, preferably has marked thereon a longitudinally disposed indicator or index line 34. Index line 34 is parallel to and midway between right and left side walls 25 and 26 of body 21. Thus, index line 34 signifies to a golfer the ideal spatial orientation of the club head velocity vector in impacting a golf ball.

Figure 2A:
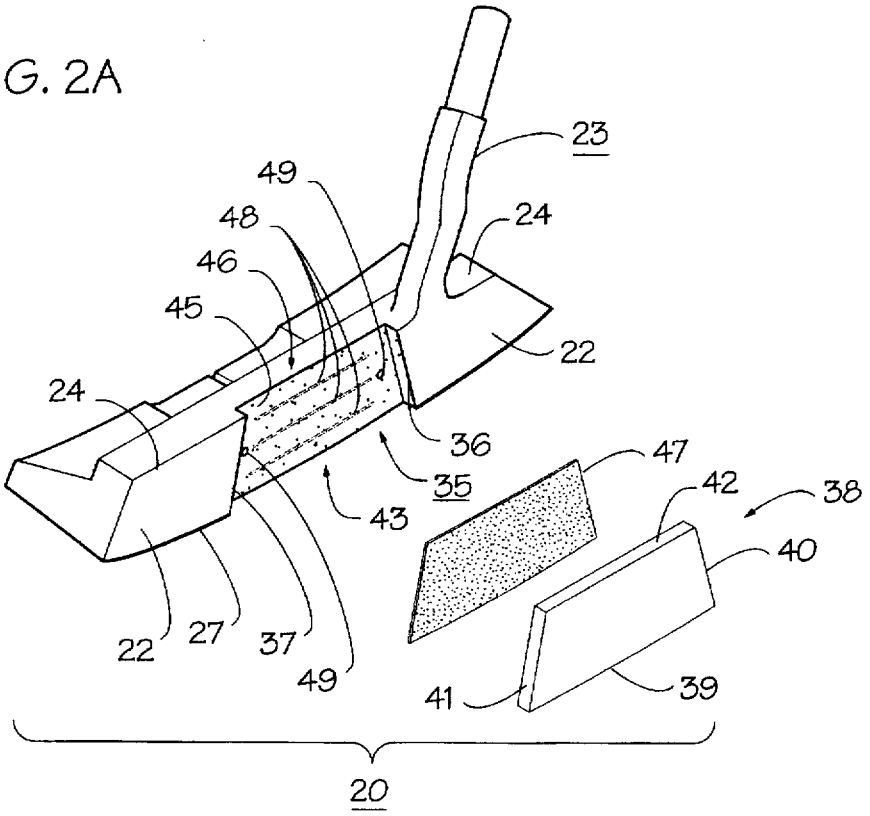
FIG. 2A is an exploded front perspective view of the club head of FIG. 1, showing the manner of installing an insert in the club.
Figure 5:
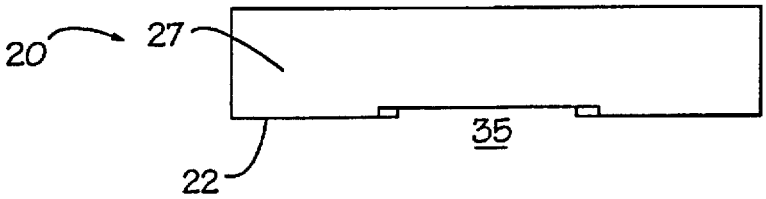
FIG. 5 is a lower plan view of the club head of FIG. 1.

Referring now primarily to FIGS. 1 and 2A, but also to FIGS. 3–5, the construction and function of novel wedging rebound control inserts used in putter head 20 will now be described in detail.

As shown in FIGS. 1 and 2A front face 22 of putter head body 21 has formed therein a recess 35 that has a uniform, wedge-shaped front plan view section. Recess 35 has angled straight right and left side walls 36 and 37 that penetrate lower wall surface 27 of club head body 21, forming a thin, laterally elongated, rectangularly-shaped opening 43 in the lower wall surface. Side walls 36 and 37 angle inwards and upwards towards upper wall surface 24 of the body, penetrating the upper wall surface and forming therein a thin, laterally elongated, rectangularly-shaped opening 46. Thus, as shown in FIGS. 1 and 2A, right and left side walls 36 and 37 of recess 35, along with those portions of straight upper wall 24 and convexly curved lower wall 27 of body 21 that are pierced by the recess, form a trapezoidal figure, the base of which is convexly curved. As may be seen best referring to FIG. 1, side walls 36 and 37 of trapezoidally-shaped recess 35 are spaced equidistant from a vertical longitudinal center plane passing through index line 34 in rear notch 32 of the body. Recess 35 is adapted to receive and securely hold a rebound control insert, as will now be described.

Referring now to FIG. 2A, putter head 20 may be seen to include a rebound control insert 38 that fits within recess 35 in front face 22 of body 21 of the head. As shown in FIG. 2A, insert 38 is fabricated from a thin sheet of polymeric material having a uniform thickness and controlled rebound characteristics. Insert 38 has a plan view shape complementary to that of recess 35. Thus, insert 38 has a horizontally disposed, slightly convexly curved lower base wall 39, and straight right and left walls 40 and 41 that angle inwards to a straight, horizontally disposed upper edge wall 42.

With insert 38 shaped as described above, the insert may be slid vertically upwards into bottom opening 43 of recess 35, with the inner flat wall surface 44 of the insert slidably contacting lower wall surface 45 of recess 35. Because of the wedge or frustoconic shapes of recess 35 and insert 38, sliding the insert parallel to club head face 22 causes the insert to "wedge" within the recess, the side walls of the insert lodging in an interference fit with the adjacent recess side walls. In this position, upper edge wall 42 of insert 38 penetrates upper opening 46 of recess 35, and lies flush with upper wall surface 24 of putter head body 21. Also in this position, lower base wall 39 of insert 38 lies flush with lower wall surface 27 of club head body 21.

In a preferred embodiment of putter head 20, insert 38 is secured to putter head body 21 by an adhesive layer 47 between inner flat wall surface 44 of the insert and lower wall surface 45 of recess 35. In an example embodiment of putter head 20, the adhesive layer 47 consisted of a double-sided adhesive tape strip. In this embodiment, insert 38 is pressed downwards into recess 35, compressing adhesive layer 47 against both the inner wall surface 44 of the insert, and the lower wall surface 45 of the recess. Thus assembled, the wedging action of insert 38 within recess 35 also secures the insert within the recess. The wedging engagement of insert 38 within recess 35 is especially effective in limiting vertical upward movement of the insert, parallel to front face 22 of putter head body 21. This is highly desirable, since the bottom wall 39 of insert 38 is most likely to encounter upward forces in normal usage, in response to downward motion of the club head to contact the ground.

As shown in FIG. 2A, lower wall surface 45 of recess 35 may optionally be provided with grooves 48 for holding adhesive used to adhere insert 38 to putter head body 21. As is also shown in FIG. 2A, wall surface 48 of recess 35 may be provided with one or more dimples 49 adapted to receive optionally provided corresponding bosses (not shown) that protrude rearward from the rear wall of insert 38, to assist in locating the insert at a desired location within the recess.

In an example embodiment of putter head 20, insert 38 has a thickness of about one-eighth (⅛) inch. Insert 38 is preferably constructed of a material that has a hardness less than that of the remainder of club head body 21, which is typically made of cast metal or hard, dense wood to provide a desired weight. Also, insert 38 is preferably made of a synthetic polymer material that has a characteristic or intrinsic rebound factor or coefficient of restitution that is selected to provide particular momentum-imparting characteristics to a ball impacted by the insert. For the purposes of discussion, rebound factor (RF) may be defined as the ratio of the height (h) reached by a ball bouncing off an insert to the height (H) the ball was dropped from onto the insert. The coefficient of restitution (CR) of the insert is defined as being equal to the ratio of rebound velocity to impacting velocity, and is equal to the square root of the rebound factor, i.e., $CR=V_{rebound}/V_{impact}=\sqrt{RF}=\sqrt{h/H}$.

According to the invention, insert 38 also preferably has a hardness that is selected according to a golfer's preference for a particular "feel" upon impacting a ball. In further accordance with the invention, inserts of a particular rebound factor are provided with different hardness values, to suit a golfer's particular desires. In an example embodiment of putter head 20 according to the present invention, insert 38 was made of solid polyurethane having a hardness in the range of Shore A 70 durometer to Shore D 70 durometer.

To adjust for different putting distances, different inserts 38 having different rebound factors were used, the rebound factors preferably varying in the range of 12.5% to 50%, or more, of the rebound factor for an ideal "live" standard, i.e., a perfectly elastic impact in which substantially all of the energy absorbed by the insert in being deformed upon impacting a golf ball, is returned to the ball. As was pointed out in the present inventor's previous disclosure, the present inventor has determined that for a particular insert durometer reading, a rebound factor of about 25 percent is desirable for a medium putt. Furthermore, a rebound factor of about 50% has been determined to be desirable for long putts, while a 12.5% rebound factor is desirable for short putts.

The actual rebound factor of a golf ball impacted by insert 38 of course depends on the coefficient of restitution of the ball, as well as that of the insert. Also, for a given golf ball coefficient of restitution, the overall rebound factor of a ball impacted by insert 38 is a composite function (composite rebound factor, CRF), depending not only upon the rebound factor of the polymer material of which the insert is made, but also upon the thickness of the insert, and upon the properties of the club head body or other object supporting the insert. Thus, for a very thin insert, the overall rebound factor depends to a larger extent on the rebound factor of the club head body 21. Conversely, for a very thick insert, the ball rebound will depend to a larger extent on the rebound factor, or coefficient of restitution characteristic of the insert material.

Because of the relationship between the composite, overall ball rebound factor and the thickness of insert 38, the thickness of a given Shore hardness insert material may be varied to vary the ball rebound factor. Thus, for example, the thickness of insert 38 can be varied to values above and below a nominal value of ⅛ inch, to values of 1/16th inch, or less to 3/16th inch, or more, for example. It is important to note that the rebound factor characteristics of the material of the insert 38, as well as the thickness of the material, may be varied over a relatively wide range, to achieve overall ball rebound factors that vary over a substantial range, while using a Shore hardness desired by a particular golfer. This rebound factor range can extend to values smaller than those of a metal, wood or composite club head without an insert 38, to substantially larger values. Table 1 lists typical rebound factors and corresponding coefficients of restitution that may be selected from. By way of comparison, a typical metal putter might have a rebound factor of about 15%.

TABLE 1

INSERT REBOUND FACTORS AND COEFFICIENTS OF RESTITUTION

| RF | CR |
|---|---|
| 50% | .707 |
| 37.5% | .612 |
| 25% | .500 |
| 12.5% | .354 |

Examples of rebound factors attained by present manufacturing methods include the following existing polyurethane compounds manufactured by the Bailey-Parks Company, 184 Gilbert Avenue, Memphis, Tenn. 38106; BP602-80A at 52%, BP625-85A at 59.5%, and BP9085-85A at 47%. The lower rebound factors are attainable for similar hardness values as desired, unlike previous plastic materials used for putter faces, such as DuPont Hytrel, wherein the rebound factor is not readily adjustable for a particular hardness.

Figure 6:
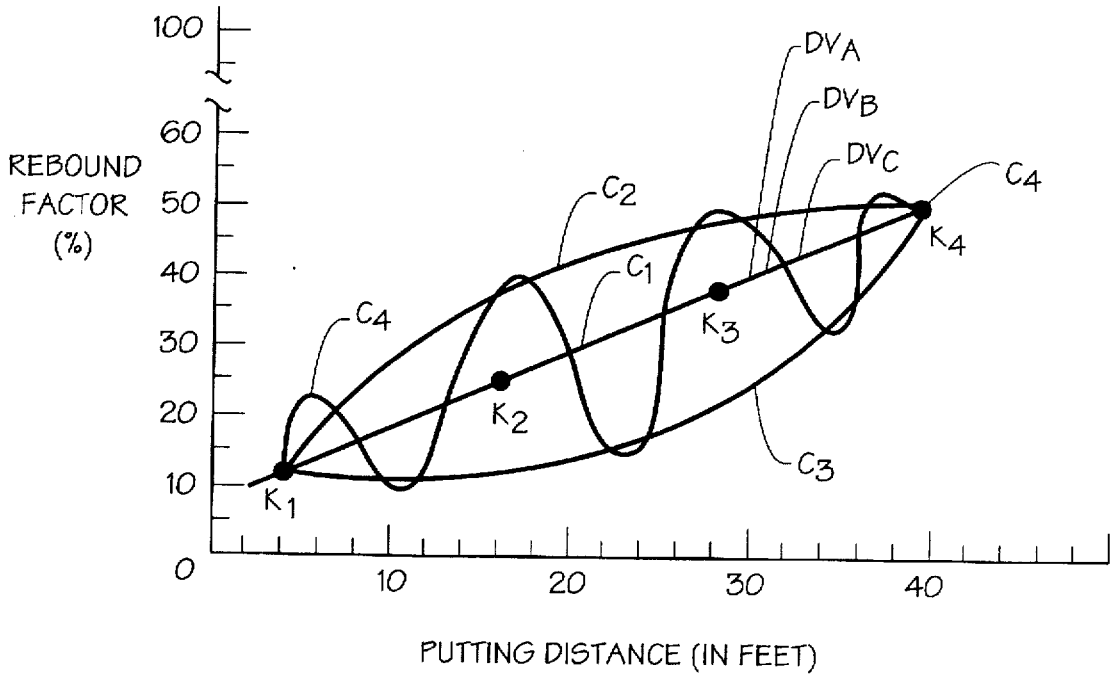
FIG. 6 is a graph showing a preferred range of insert rebound factors versus putting distance, according to the present invention.

The particular rebound factor of an insert is preferably chosen as a function of the putting distance to a hole, as is illustrated in FIG. 6 and discussed below.

When a golf ball is impacted by insert 38 of putter head 21, the ball compresses the insert a pre-determined amount at the region of impact, the amount of compression depending upon the selected rebound factor. For inserts made of relatively lower resiliency materials, a larger proportion of the impact energy is absorbed by deformation of the insert, so that a golf ball is driven a shorter distance, with consequent greater control of ball direction and roll, than would otherwise be the case with prior art putters. This greater control enables a golfer to execute a smooth, continuous full swing in impacting the ball, without fear of over-driving the ball.

Depending upon the distance to the cup and the degree of control and feel required to sink a putt, the golfer can preselect a suitable putter from a set of putters, each provided with an insert 38 having a different rebound factor. A set of rebound factors for inserts 38 found suitable for most applications by the present inventor includes values of 12.5%, 25%, 37.5% and 50% or greater. Preferably, inserts 38 with different rebound factors are color coded, to facilitate quick selection of a putter provided with an insert having a desired rebound factor.

A graph plotting suitable rebound factors for inserts 38, as a function of approximate putting distance, is given in FIG. 6. As shown in FIG. 6, the present inventor has found that an insert 38 having rebound factor K1 of about 12.5% is suitable for short putts, of the order of 4 feet or less. Similarly, a rebound factor K2 of about 22.5% for putts of about 16 feet, K3 of about 37% for putts of about 28 feet, and K4 of about 52% for putts of about 40 feet were found suitable.

As indicated in FIG. 6, what appears to be a single (straight line) curve C1 plotting desired rebound factors of inserts 38 as a function of putting distance, is in actuality a coalescence of three separate identical straight line plots, for inserts having three different hardnesses in the durometer range of 70A to 70 D. Thus, using a polymeric material of the type specified above, in which rebound factors may be varied over a desired range, while fixing hardness as a parameter, enables a golfer to not only choose an insert 38 having a rebound factor RF most suitable for a particular putting distance, but also to choose independently the insert hardness that provides the golfer with the desired feel.

As shown in curve C1 of FIG. 6, the preferred functional relationship between rebound factor and putting distance is linear. However, it is to be understood that the precise values of rebound factor K may vary somewhat because of ordinary variations in manufacturing tolerances. Also, it may be desired to increase or decrease the rebound factors for intermediate putting distance from the values shown for the linear curve C1 in FIG. 6. Thus, the functional relationship between rebound factor and putting distance may deviate from the linear curve C1 shown in FIG. 6, either upward to convex curve C2 or downwards, to concave curve C3, or alternating upwards and downwards, as illustrated by curve C4. Such variations are within the scope of the invention, and achieve the desired beneficial results, as long as rebound factor RF is a single-valued, increasing function of putting distance.

As described above, inserts 38 were fabricated from a resilient polyurethane material. Other resilient polymers may also be used for insert 38, provided that the polymer affords the desired combination of a selectable Shore hardness and rebound factor. For polyurethane having a hardness in the range of Shore A70 durometer to shore D70 durometer stated in the examples above, the material may be referred to as an elastomer. However characterized, I have found that the resilience of insert 38 affords a distinct advantage over club head constructions employing solid, non-resilient inserts. A problem exists with solid inserts, because differing coefficients of thermal expansion for the insert and club head materials can cause loosening of the insert, or permanent warpage of the insert and/or the head, if left inside a hot automobile, for example.

Figure 2B:
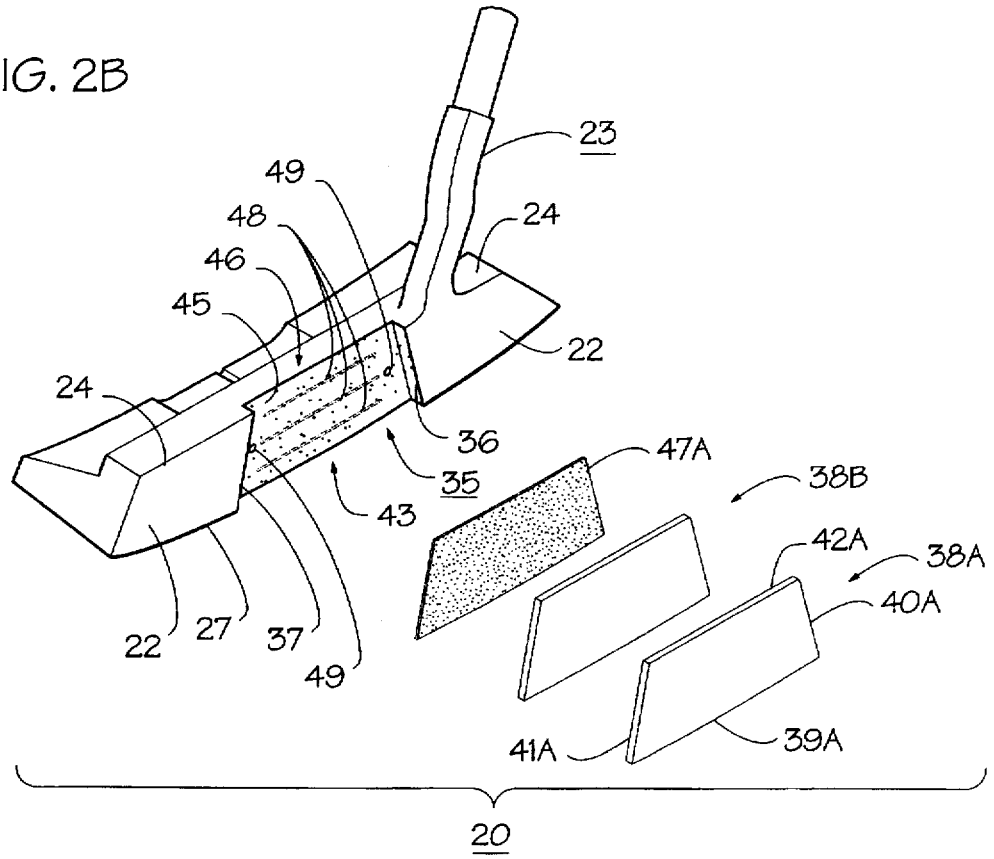
FIG. 2B is a fragmentary exploded front perspective view of the club head of FIG. 1, showing a modified multi-lamination insert.

FIG. 2B illustrates a modification of the putter head according to the present invention. The modified putter head 20A in FIG. 2B utilizes a plurality of stacked inserts, such as inserts 38A and 38B, rather than a single insert. This multi-layered, laminated insert structured, as shown in FIG. 2B, utilizes inserts made of resilient materials having different durometer hardnesses and/or different rebound factors. Stacking two or more insert laminations such as 38A and 38B which have different rebound factors and/or hardnesses allows the overall rebound factor, and/or the perceptible hardness, of the stacked lamination to be varied over a substantially larger range than could be achieved with a unitary, one-piece insert. The range of variability can be further increased by varying the thickness of one or more of the laminations used to make the insert, as is described in further detail below.

In tests performed by the present inventor, outer insert 38A and inner insert 38B were made from materials having different durometer values and/or rebound factors, and thicknesses of 1/16 inch, 1/8, and 1/4 inch. In a first example, a 1/8 inch thick inner or bottom insert 38B having a high rebound factor was overlain with a 1/16 inch thick upper or outer insert 38A having a lower rebound factor. The laminations 38A and 38B were adhered to one another and to lower surface 45 of recess 35 in club head body 21 with 3M double stick tape. With a high rebound factor insert 38B on the bottom and a low rebound factor insert 38A on top, the overall rebound factor of the dual lamination insert increased approximately 30% over the rebound factor of a single 3/16 inch thick insert having the same low rebound factor as outer lamination 38A.

In example 2, a laminated insert 38 was made with laminations 38A and 38B reversed, i.e., with a low rebound factor, inner insert 38B, and a high rebound factor outer insert 38A. In this case, the overall rebound factor of the dual lamination was less than that of a single 3/16 inch insert having the same high rebound factor as outer insert lamination 38A.

In a third example embodiment of a dual lamination, multi-layer insert, inner or bottom insert lamination 38B was made from a 1/8 inch thick polyurethane sheet having an 85A durometer and a high rebound factor. The outer or top insert lamination 38A was made from a 1/8-inch thick polyurethane sheet having an 85A durometer and a low rebound factor. With this arrangement, the overall rebound factor was altered to a value intermediate the intrinsic rebound factors of the two insert lamination materials, i.e., to a value somewhat larger than the low rebound factor of outer lamination 38A.

In example 4, the relative positions of the low and high rebound factor insert laminations 38A and 38B were reversed, thus positioning the high rebound factor material in the outer insert location. With this arrangement, the overall rebound factor was decreased from the high rebound factor of outer lamination 38A.

In example 5, the low rebound factor inner insert lamination 38B of example 4 was replaced with a polyurethane material having a similar low rebound factor, but of somewhat greater hardness. In this case, the overall rebound factor decreased approximately 25% from the intrinsic rebound factor of the outer insert 38A. In addition, the perceptible hardness of the two-lamination insert upon impacting a golf ball increased over that experienced using the outer insert material alone.

In a sixth example, a series of tests were performed in which the relative thicknesses of inner insert lamination 38B and outer insert lamination were varied to determine the effects of thickness ratios on alterations of overall rebound factor and/or perceptible hardness of outer insert lamination 38A by inner insert lamination 38B. In these tests, it was determined that if outer lamination 38A had a greater thickness than inner lamination 38B, for example, 1/4 inch versus 1/16 inch, the durometer and rebound factor characteristic of the inner lamination material had relatively smaller effects on the overall rebound factor and perceptible hardness of the multi-layer insert. Conversely, when the thickness inequality was reversed, with a thinner outer insert lamination 38A compared to inner lamination 38B, 1/16-inch versus 1/4-inch, for example, the overall rebound factor and perceptible hardness were more strongly affected by the durometer and rebound factor of inner insert 38B.

In general, it was observed that the overall rebound factor was more strongly affected by the rebound factor of inner insert lamination 38B, than perceptible hardness by the hardness of inner insert lamination 38B. Thus, in example 7, a dual-lamination insert was made using a 1/8-inch thick outer insert of 90A durometer, and an inner insert lamination of 1/8 inch thickness and 70A durometer. In this example, the perceptible hardness of the combination decreased only slightly. With the thickness of the outer 90A durometer insert 38A reduced to 1/16 inch, the effect was greater, reducing the perceptible hardness by about 15%.

Figure 8:
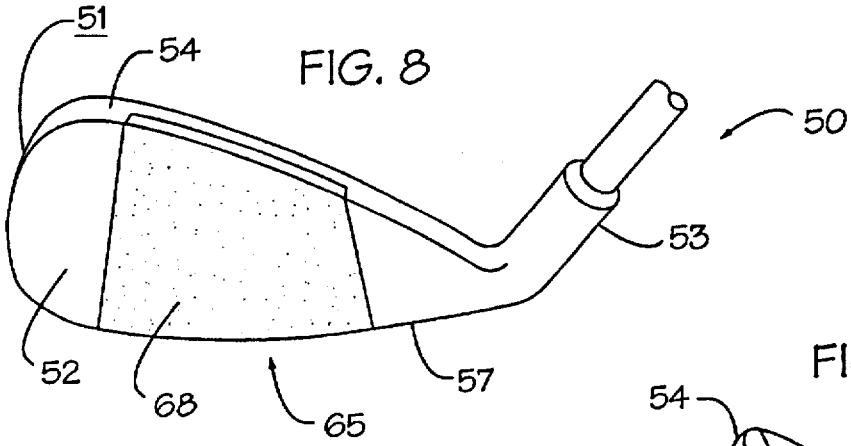
FIG. 8 is an upper plan view of the club head of FIG. 7.
Figure 9:
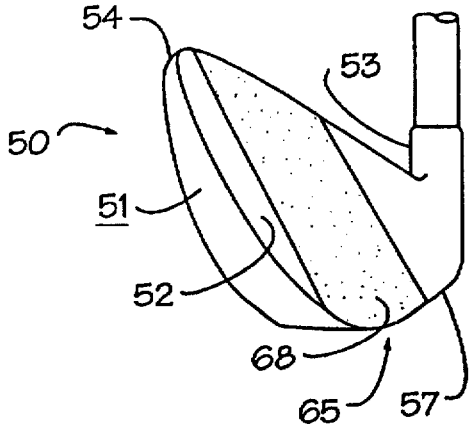
FIG. 9 is an outer side elevation view of the club head of FIG. 7.
Figure 7:
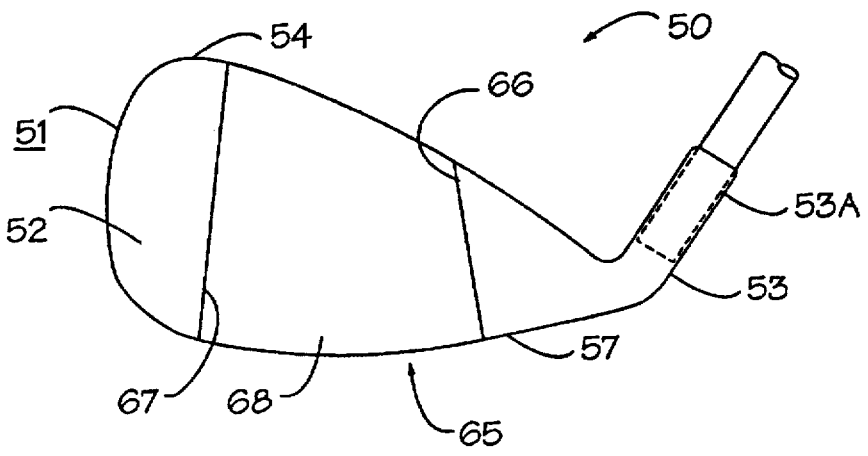
FIG. 7 is a front elevation view of a wedge golf club head with a wedging insert according to the present invention.

FIGS. 7–9 illustrate another type of golf club head incorporating a rebound control insert according to the present invention. The club head shown in FIGS. 7–9 belongs to a major category of clubs referred to as "irons," the other major category being referred to as "woods." Iron club heads are typically made of metal, and have the general appearance of a relatively thick plate having a flat front surface or face for impacting a ball. The face is disposed angularly upwards and backwards from the horizontal lower edge of the plate, which is adapted to contacting the ground and referred to as the sole. A shank having a blind bore for receiving a shaft angles upward and rearward from one side of the plate. Woods have a similarly disposed ball impacting surface and shank, but typically have a large oval or bulbous weight-adding portion that protrudes rearward from the ball impacting front face of the club.

Referring now to FIGS. 7 through 9, a wedge golf club head 50 according to the present invention may be seen to include a horizontally elongated, plate-like body 51 having a generally flat front face 52 adapted to impacting a golf ball. Club head body 51 has an elongated, straight, generally cylindrically-shaped shank 53 that angles upwards from the upper edge wall 54 of the body. As may be seen best by referring to FIG. 7, shank 53 also angles obliquely away from the lower flat edge wall or sole 57 of body 51. Shank 53 has a concentric blind bore 53A adapted to insertably receive a golf club shaft (not shown).

As shown in FIG. 9, front face 52 of club head body 51 angles dihedrally rearward from a vertical plane intersecting the front edge of the horizontally disposed lower surface or sole 57 of the body. The purpose of this inclination is to provide a relatively large vertical component or "loft" to the trajectory of an impacted ball. Typical inclination or loft angles for conventional wedge club heads range from about 52 degrees to 64 degrees, and any appropriate inclination angle can be chosen for club head 51.

As may be seen best by referring to FIGS. 7 and 8, front face 52 of wedge club head body 51 has formed therein a recess 65 that has a uniform, wedge-shaped front plan view section. Recess 65 is substantially identical in structure and function to recess 35 of putter head 20 described above. Wedge golf club head 50 also includes a rebound control insert 68 that fits within recess 65 in front face 52 of body 51 of the head. With the exception noted below, rebound control insert 68 is substantially similar in structure and function to insert 38 of putter head 20 described above. Thus, wedge golf club head 50 has elements 65 through 77 that correspond to elements 35 through 47, respectively, of putter head 20. Since those putter head elements were described in detail above, descriptions of the corresponding wedge club head elements will not be repeated here.

Rebound control insert 68 for wedge club head 50 is preferably made of a polymer material similar to that previously disclosed for putter head insert 38. Thus, the preferred Durometer range for insert 68 used in wedge club head 50 is 80A to 80D, while a preferred set of rebound factors is 12.5%, 32.5%, 37% and 50%.

Figure 7A:
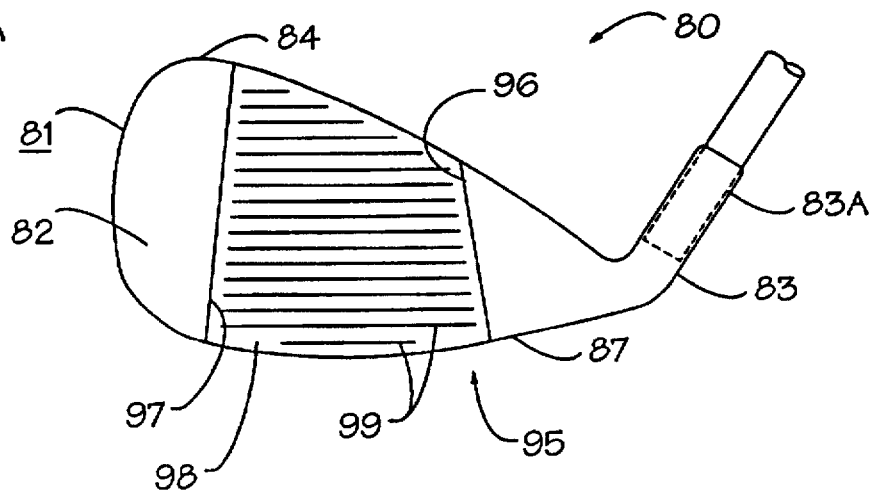
FIG. 7A is a front elevation view of a modification of the club head shown in FIG. 7.

FIG. 7A shows a modification of the wedge club head 50 shown in FIG. 7. In the modified wedge club head 80, insert 98 has formed in the outer flat face thereof a plurality of parallel, horizontally disposed grooves 99. The function of grooves 99 is to increase vertical traction between the wedge club head 80 and a ball impacted by insert 98, thereby imparting greater spin to the driven ball. In some situations a golfer will choose to add a downward vertical component to the club head trajectory, for the purpose of imparting back spin on a ball. The purpose of back spin is to minimize roll of a ball after impacting the green, allowing a golfer to land the ball near the cup, without rolling away from the cup.

Figure 7B:
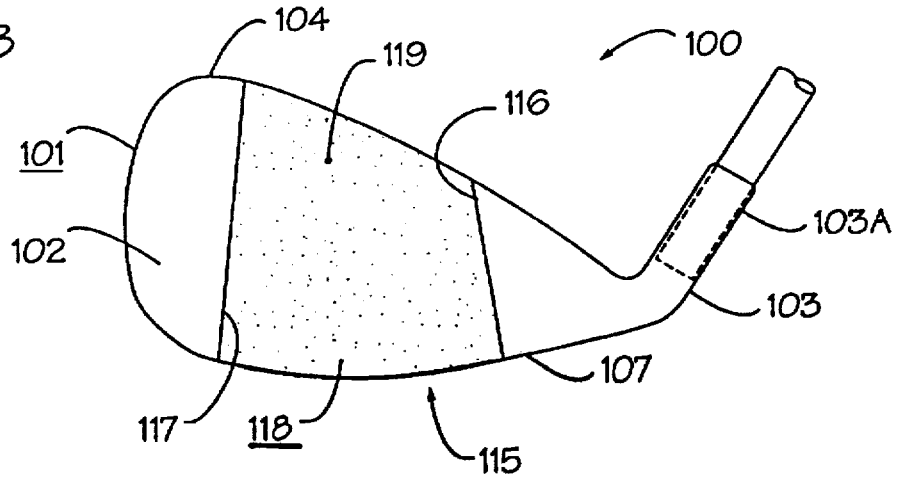
FIG. 7B is a front elevation view of modification of the insert shown in FIG. 7.

FIG. 7B illustrates another modification of wedge club head 50. In that modification, wedge club head 100 has an insert 118 having front face 119 which is scuffed, sandblasted, or otherwise textured to increase the coefficient of friction between the front face and the surface of an impacted ball, thereby providing better spin control of the ball.

Figure 10:
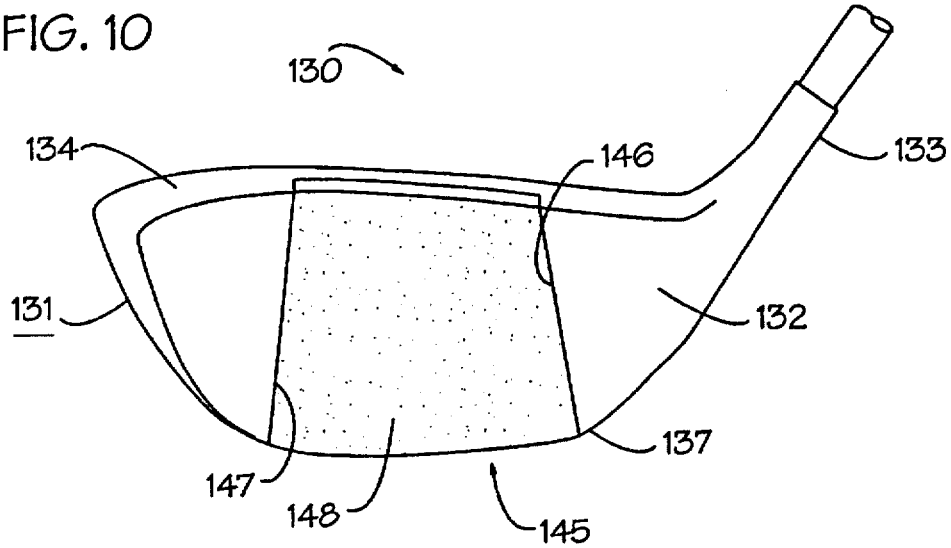
FIG. 10 is a front elevation view of a "two wood" golf club head with a wedging insert according to the present invention.
Figure 11:
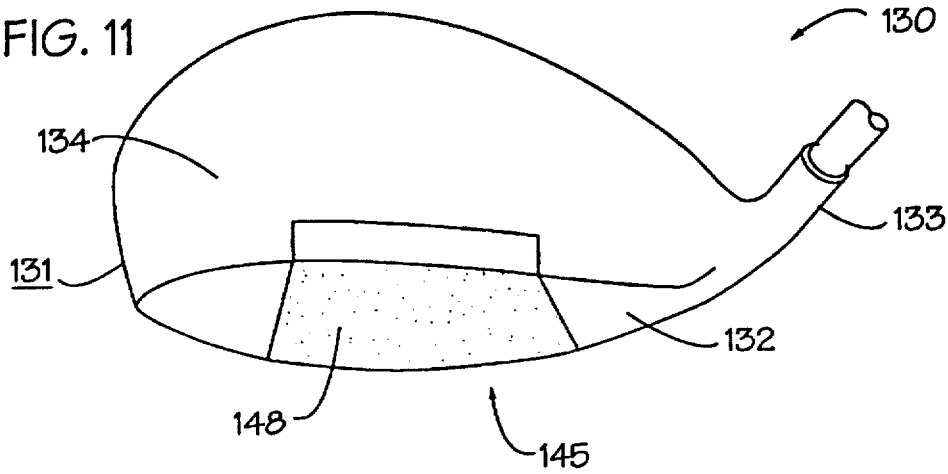
FIG. 11 is an upper plan view of the club head of FIG. 10.
Figure 12:
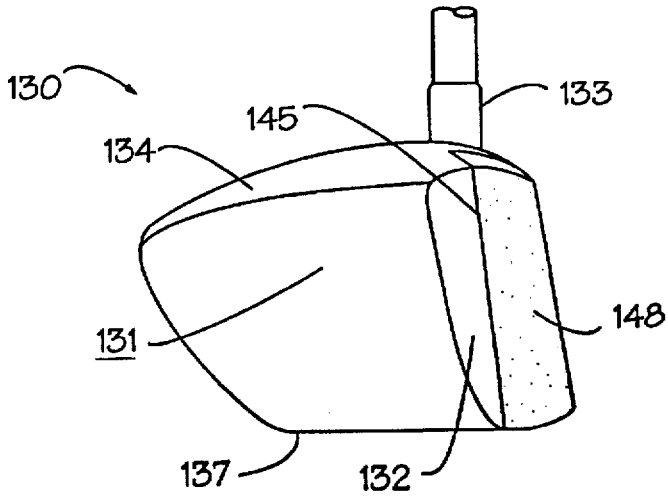
FIG. 12 is an outer side elevation view of the club head of FIG. 10.

FIGS. 10–12 illustrate a "wood" golf club head provided with a rebound control insert according to the present invention. Here "wood" is used to describe golf clubs having a substantially bulbous body rearward of the face of the club head, and which are used to drive balls relatively long distances. The first such clubs had wooden heads, hence the name. Modern "woods" are often made of graphite, stainless steel or other metal, inorganic or composite material.

Referring now to FIGS. 10–12, a wood club head 130 according to the present invention may be seen to include a relatively bulbous body 131 having a generally flat front face 132 adapted to impacting a golf ball. Body 131 of wood club head 130 has an elongated, straight, generally cylindrically-shaped shank 133 that angles upwards from the upper convex surface 134 of the body. As may be seen best by referring to FIG. 10, shank 133 also angles obliquely away from the lower flat surface or sole 137 of body 131.

As may be seen best by referring to FIGS. 10 and 11, front face 132 of wood head body 131 has formed therein a recess 145 substantially identical in structure and function to recess 35 of putter head 20 described above. Recess 145 wedgingly receives an insert 148 substantially similar in structure and function to insert 38 of putter head described above. However, the preferred rebound factors for insert 148 used in wood club head 130 would typically be greater than those used for putters, exceeding 50%. Also, the hardness range for inserts 148 used in woods would also typically be greater, extending from 50D to 80D, for example.

Figure 13:
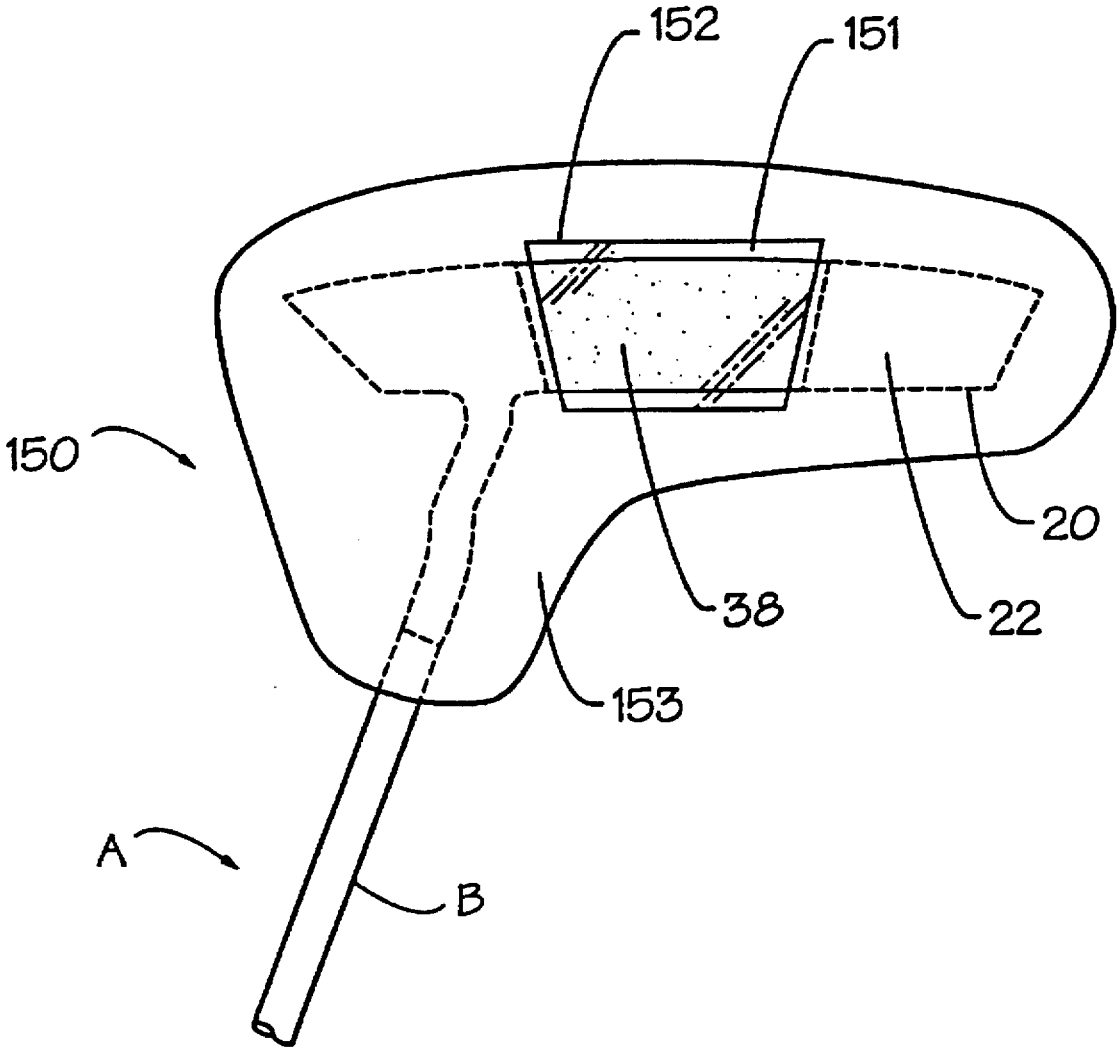
FIG. 13 is an upper perspective view of an inverted golf club provided with a head of the type shown in FIG. 1, and showing the club head fitted with a windowed protective cover according to the present invention.

FIG. 13 illustrates a protective golf club head cover or mitt that is particularly well suited to use with golf clubs having color coded inserts according to the present invention. As shown in FIG. 13, a protective cover 150 according to the present invention is fitted over a putter head 20 of a putter A, the putter head being in an inverted position with a putter shaft B extending downwards into a golf bag (not shown) holding the putter. Protective cover 150, which is made of a soft, durable, drapable material such as soft leather or fabric, has a hollow tubular shape similar to that of a tube sock, and is adapted to be pulled over a putter head 20 and the lower portion of shaft B of putter A. A generally rectangularly-shaped, horizontal elongated transparent window 151 made of thick transparent vinyl or other such material, is attached within a similarly shaped aperture 152 formed in a side wall 153 of cover 150. Window 151 of protective cover 150 is so located within side wall 153 as to overly at least a portion of a color-coded rebound control insert 38 in the front face 22 of putter head 20, with the protective cover fitted over the putter head. This arrangement permits a golfer to easily select a golf club provided with a desired color-coded insert, from a plurality of clubs fitted with protective covers 150 and contained in a golf bag.

What is claimed is:

1. A golf club head comprising a body having a front face and a resilient pad affixed to said front face of said body, said pad having an outer surface defining an intended ball impact region and having a rebound factor (RF) selected from a first plurality of values and a thickness selected from a second plurality of values so as to provide in combination with said body a controlled composite rebound factor (CRF) for a golf ball impacted by said club head, said composite rebound factor being related to the distance from an intended target by a pre-determined relationship.

2. The golf club head of claim 1 wherein said resilient material is further defined as having a hardness or durometer value (DV) selected from a plurality of values.

3. The golf club head of claim 1 wherein said pre-determined relationship between said CRF and said intended target distance is further defined as being a single valued function of said intended target distance.

4. The golf club head of claim 3 wherein said function is further defined as being quasi-linear.

5. The golf club head of claim 4 wherein said resilient pad is further defined as being an insert fitted into a recess provided in the front face of said golf club head.

6. The golf club head of claim 5 wherein said insert has side walls which cooperate with side walls of said recess to help maintain said insert at a fixed location within said recess.

7. The golf club head of claim 6 wherein said insert has a wedge-shaped plan view.

8. The golf club head of claim 1 wherein said resilient pad is further defined as being made from a polymer.

9. The golf club head of claim 8 wherein said polymer is further defined as being an elastomer.

10. The golf club head of claim 9 wherein said elastomer is further defined as being polyurethane.

11. A golf club head including a body having an upper wall surface, a lower sole surface and having a front face adapted to impact a golf ball, said face having formed therein a recess in which is fitted a rebound control insert structure comprising at least a first insert made of a resilient material having a rebound factor (RF) selected from a first plurality of values and a thickness selected from a second plurality of values so as to provide in combination with said body a controlled composite rebound factor (CRF) for a golf ball impacted by said club head, said composite rebound factor being related to the distance from an intended target by a pre-determined relationship.

12. The golf club head of claim 11 wherein said recess is further defined as extending through said upper wall surface of said head.

13. The golf club head of claim 12 wherein said recess is further defined as extending through said lower, sole surface of said club head.

14. The golf club head of claim 13 wherein said recess is further defined as having angled side walls.

15. The golf club head of claim 13 wherein said insert structure is further defined as having substantially the same plan view shape as that of said recess, whereby said recess may wedgingly and resiliently receive said insert structure.

16. The golf club head of claim 11 wherein said rebound control insert structure is further defined as comprising a laminated stack of inserts including said first insert and at least one additional insert.

17. The golf club head of claim 16 wherein each of said inserts is further defined as having a hardness or durometer value (DV) selected from a third plurality of values.

18. The golf club head of claim 17 wherein each of said inserts of a selected RF is further defined as having a thickness (T) selected from a fourth plurality of values, whereby the composite rebound factor (CRF) of a ball impacted by the insert region of the club head may be adjusted to a selected one of CRF's for given RF's.

19. The golf club head of claim 18 wherein at least one of said inserts in said laminated stack may have any of said thickness, hardness or rebound factor values different from the corresponding value for another of said inserts in said laminated stack, whereby the composite rebound factor and perceptible hardness of said laminated structure may be independently varied.

20. A series of golf clubs, each of said clubs comprising;

a. a shaft, b. a club head including a body having a front face with an intended golf ball impact region, and c. at least one insert formed of a resilient material, said insert being disposed at said impact region of said club head and having a composite rebound factor selected from a first plurality of values, said composite rebound factor being determined by the intrinsic rebound factor characteristic of the particular material of which said insert is made, and by the thickness of said insert in combination with the characteristics of said body, said composite rebound factor values being related to different intended distances to a target by a quasi-linear relationship.

21. The series of golf clubs of claim 20 further defined as including at least one putter.

22. The series of golf clubs of claim 20 further defined as including at least one wood.

23. The series of golf clubs of claim 20 further defined as including at least one iron.

24. The series of golf clubs of claim 20 wherein said insert is further defined as having a hardness or durometer value (DV) selected from a second plurality of values.

25. A series of golf clubs, each of said clubs having in the head thereof at least one resilient insert forming a ball impacting region of the face of said club head, wherein each of said inserts is formulated from a material to effect a pre-selected and reproducible intrinsic rebound factor (RF), and the thickness of each of said inserts is selected to yield in combination with said intrinsic rebound factor a resultant, composite rebound factor (CRF) of a ball impacted by the insert region of said club, said composite rebound factor being related to the distance from an intended target by a pre-determined relationship.

26. The series of golf clubs of claim 25 further defined as including at least one putter.

27. The series of golf clubs of claim 25 further defined as including at least one wood.

28. The series of golf clubs of claim 25 further defined as including at least one iron.

29. The series of claim 25 wherein said insert is further defined as having a hardness or durometer DV value selected from a plurality of values.

* * * * *